US010109187B2

(12) United States Patent
Lees

(10) Patent No.: US 10,109,187 B2
(45) Date of Patent: Oct. 23, 2018

(54) VEHICLE DETECTION APPARATUS

(71) Applicant: Red Fox I.D. Ltd, Stubton Nottinghamshire (GB)

(72) Inventor: Richard Andrew Lees, Cattai (AU)

(73) Assignee: Red Fox I.D. Ltd, Stubton Nottinghamshire (GB)

( * ) Notice: Subject to any disclaimer, the term of this patent is extended or adjusted under 35 U.S.C. 154(b) by 0 days.

(21) Appl. No.: 15/552,310

(22) PCT Filed: Feb. 26, 2016

(86) PCT No.: PCT/GB2016/050496
§ 371 (c)(1),
(2) Date: Aug. 21, 2017

(87) PCT Pub. No.: WO2016/139456
PCT Pub. Date: Sep. 9, 2016

(65) Prior Publication Data

US 2018/0040242 A1 Feb. 8, 2018

(30) Foreign Application Priority Data

Mar. 5, 2015 (GB) ..... 1503692.4

(51) Int. Cl.
*G08G 1/01* (2006.01)
*G08G 1/042* (2006.01)

(52) U.S. Cl.
CPC ..... *G08G 1/042* (2013.01)

(58) Field of Classification Search
CPC ..... G08G 1/042
(Continued)

(56) References Cited

U.S. PATENT DOCUMENTS 4,239,415 A * 12/1980 Blikken ..... E01F 11/00 324/234
4,368,428 A * 1/1983 Dijkman ..... G01P 3/54 324/178
(Continued)

FOREIGN PATENT DOCUMENTS

DE 4234548 C1 9/1993
EP 1028404 A2 8/2000
(Continued)

*Primary Examiner* — Santiago Garcia
(74) *Attorney, Agent, or Firm* — Jacob M. Ward; Ward Law Office LLC

(57) ABSTRACT

Apparatus is disclosed for monitoring use of a carriageway, the carriageway having two or more lanes (12, 14, 16) for use by vehicles travelling in a single direction A, the apparatus including: a pair of inductive loops (20*abc*, 22*abc*) on or in the surface of each lane (12, 14, 16), the loops in the pair being positioned substantially side-by-side across the lane (12, 14, 16) and the pairs of loops (18*a*, 18*b*, 18*c*) being positioned substantially side-by-side across the carriageway, each pair of loops (18*abc*) substantially extending across the full width of the lane (12, 14, 16), and each loop having a length in the direction of vehicle travel which is substantially shorter than the width of the loop across the lane; a loop controller associated with each loop, each loop controller energising its associated loop and carrying out measurements of the inductance of its associated loop; and processing means for receiving the measurements from the loop controllers, and for using the measurements for calculating the estimated position of vehicle(s) on the carriageway.

11 Claims, 2 Drawing Sheets

(58) Field of Classification Search
USPC ..... 340/941
See application file for complete search history.

(56) References Cited

U.S. PATENT DOCUMENTS 5,404,306 A * 4/1995 Mathur ..... G08G 1/04 348/149
5,708,427 A * 1/1998 Bush ..... G05D 1/0261 180/168
5,798,983 A * 8/1998 Kuhn ..... H04B 11/00 367/127
6,021,364 A * 2/2000 Berliner ..... G08G 1/01 340/943
6,204,778 B1 * 3/2001 Bergan ..... G08G 1/075 340/905
6,345,228 B1 * 2/2002 Lees ..... G08G 1/01 324/236
6,483,443 B1 * 11/2002 Lees ..... G08G 1/042 340/919
7,136,828 B1 * 11/2006 Allen ..... G08G 1/017 705/13
7,734,500 B1 * 6/2010 Allen ..... G07B 15/063 701/1
2003/0163263 A1 * 8/2003 Bertrand ..... G08G 1/042 702/65
2005/0203697 A1 * 9/2005 Dalgleish ..... G08G 1/01 701/117
2006/0037400 A1 * 2/2006 Haynes ..... G01S 11/14 73/587
2009/0174575 A1 * 7/2009 Allen ..... G07B 15/063 340/933
2011/0163894 A1 * 7/2011 Grievink ..... G08G 1/042 340/932.2
2012/0307065 A1 * 12/2012 Mimeault ..... G08G 1/04 348/149
2013/0259386 A1 * 10/2013 Chandrashekar .... G06K 9/4633 382/203
2015/0048689 A1 * 2/2015 Ookawa ..... H02J 5/005 307/104
2015/0134232 A1 * 5/2015 Robinson ..... G08G 1/0116 701/117
2016/0258777 A1 * 9/2016 Bodake ..... G01C 21/367

FOREIGN PATENT DOCUMENTS

GB 2373619 A 9/2002
WO 9729468 A1 8/1997

* cited by examiner

VEHICLE DETECTION APPARATUS

CROSS-REFERENCE TO RELATED APPLICATIONS

This patent application is a U.S. National Stage of International Patent Application No. PCT/GB2016/050496, filed Feb. 26, 2016, which in turn claims priority to Great Britain Patent Application 1503692.4, filed Mar. 5, 2015. The entire disclosures of the above patent applications are hereby incorporated herein by reference.

FIELD

The present invention relates to apparatus for detecting and counting vehicles travelling along a carriageway, in particular to apparatus including inductive loops on or in the road surface.

BACKGROUND TO THE INVENTION

It is known to use various different types of apparatus to monitor usage of a road, which is done for various purposes, including to identify congested areas and plan future infrastructure.

Currently-used apparatus includes various types of overhead sensors, for example laser sensors or video cameras. However, these types of sensors suffer from reduced accuracy whenever there is rain, mist or snow. They can be expensive to install, and their overhead location makes them vulnerable to damage by electrical storms and sometimes vandalism.

Inductive loops are also known, and can be buried in the road to detect traffic as it passes over the loop. Inductive loops are generally cheaper to install, more reliable and less vulnerable to damage as compared with overhead sensors, but suffer from a lack of accuracy in certain road conditions. For example, in an area where vehicles often change lanes, vehicles can be mis-counted if they are straddling two lanes when passing over the loops. This is because it can be difficult to determine whether inductive disturbances occurring in loops in two adjacent lanes result from passage of two vehicles in adjacent lanes, or from a single vehicle straddling the two lanes. Motorcycles are also prone to mis-counting, since they often drive between lanes, and sometimes two motorcycles ride side-by-side in a single lane.

EP1028404 discloses an arrangement of two inductive loops, one after the other along each lane. The loops are each positioned substantially centrally of each lane, and the lateral gap between the edges of the loops is around 1.5 meters (5 feet) in a typical installation. This system works well for traffic which has good lane discipline, but accuracy suffers in situations where many vehicles are changing lanes over the measurement site, or where the vehicle mix includes more than a small proportion of motorcycles. It is sometimes possible to distinguish one straddling vehicle from two in-lane vehicles by evaluating the geometric mean of the peak change in inductance in loops in adjacent lanes, and testing the geometric mean against a threshold, but the accuracy of this method leaves room for improvement, and motorcycles are often missed altogether.

It is an object of the invention to reduce or substantially obviate the above mentioned problems.

STATEMENT OF INVENTION

According to the present invention, there is provided apparatus for monitoring use of a carriageway, the carriageway having two or more lanes for use by vehicles travelling in a single direction, the apparatus including:

- a pair of inductive loops on or in the surface of each lane, the loops in the pair being positioned substantially side-by-side across the lane and the pairs of loops being positioned substantially side-by-side across the carriageway, each pair of loops substantially extending across the full width of the lane, and each loop having a length in the direction of vehicle travel which is substantially shorter than the width of the loop across the lane;
- a loop controller associated with each loop, each loop controller energising its associated loop and carrying out measurements of the inductance of its associated loop; and
- processing means for receiving the measurements from the loop controllers, and for using the measurements for calculating the estimated position of vehicle(s) on the carriageway.

The arrangement of inductive loops according to the invention allows for accurate determination of the lateral position of a vehicle as it passes over the loops. By evaluating the signals from the loops in combination, a single vehicle straddling two lanes, or two vehicles (e.g. motorcycles) travelling in a single lane can be accurately detected and distinguished.

Each pair of loops substantially extends across the full width of each lane. Of course, in practice there will be a small gap between loops in adjacent lanes, but the size of the lateral gap is much smaller than in existing systems, typically less than around 30 cm (1 foot). A lateral gap of this size is sufficiently small to ensure detection of motorcycles riding between lanes, but sufficiently large to ensure that inductive coupling between loops does not cause excessive noise or loop controller malfunction, and to ensure that the inductive effect of a vehicle passing in an adjacent lane is minimal.

The lateral gap between the two loops in each pair is preferably as small as possible, and in fact the lateral edges of the two loops in the pair are coincident in some embodiments. If the loops are arranged in slots cut into the road surface, a single central slot may accommodate the inner lateral edge of each loop in a single loop pair. This keeps the number of slots to an absolute minimum, to avoid compromising the strength of the road surface.

Optionally, a second pair of loops may be provided in each lane, spaced along the road from the first pair of loops.

In some embodiments, the loops in each loop pair may overlap. This effectively creates three detection zones across the lane a zone over the first loop only, a zone over the second loop only, and a central zone over both loops. This increases the accuracy with which the lateral position of a vehicle can be measured, in particular for narrow vehicles such as motorcycles.

Since the two loops in a pair may be coincident or even overlapping, the loop controllers must be configured to ensure that the two loops in the pair do not interfere with each other. The energising frequencies of each loop in the pair may be different and chosen not to interfere with each other. Alternatively, the loop controllers may be configured so that the loops are never energised together, as long as each loop is energised sufficiently often (typically around 100 times each second or more frequently) to detect vehicles travelling at the maximum speed envisaged on the particular carriageway.

Where the loops in the pair overlap and a second pair of loops are provided, the loops of the second pair may be non-overlapping. This increases the possible detection accuracy, in particular in terms of distinguishing a single motorcycle in the overlapped zone from a pair of side-by-side motorcycles passing over the non-overlapped zones.

The apparatus according to the invention also allows for classification of vehicles passing over the loops. By analysing characteristics of the change of inductance measured in the loops, motorcycles, cars, vans, and lorries can be distinguished.

It will be appreciated that the loop controllers may be provided as a single, integrated device. However, there are multiple controllers in the sense that the inductance of each loop is independently measured. Preferably, each loop controller measures the inductance of its associated loop multiple times in one second.

A secondary loop may be provided in at least one lane. The secondary loop typically has a length in the direction of vehicle travel (along the lane) which is substantially similar to its width across the lane. The secondary loop may be positioned substantially centrally of its lane, and is will often be coincident with the pair of loops on the same lane, or coincident with both pairs of loops where a second pair of loops is provided. The secondary loop(s), where provided, extend laterally across only a portion of the lane width, and are therefore laterally separated from each other by significantly larger gaps than the narrow loops.

The secondary (longer) loop is used to provide more accuracy where high-bed vehicles use the carriageway. The longer loop is able to better detect high-bed vehicles. In some embodiments, high-bed vehicles will generally use only a subset of the lanes of the carriageway, and so the secondary loop can be omitted from lanes which are generally only open to cars and other small vehicles.

Preferably, each loop in each pair will be of approximately the same width. It is possible in some embodiments to have loops of different widths but the subsequent signal processing in these cases needs to be modified to account for the different lengths.

The inductive loops may be substantially in the form of loops of conducting wire, embedded in the road surface.

It will be understood that a carriageway in this context means a set of side-by-side lanes which are used by vehicles travelling in a single direction. Roads often include two adjacent carriageways to allow vehicles to travel in each direction, and the carriageways may or may not be separated by a barrier or other separator. Roads also sometimes include shoulder lanes, and vehicles in these lanes may sometimes not need to be monitored, and therefore no loops need to be installed in those lanes. In some cases, existing single-loop systems may be installed in shoulder lanes to save costs, since accurate position information is less critical and the lanes tend to be narrower. Likewise, some particularly wide lanes may include three or more loops for accurate detection of the position (especially of narrow vehicles) travelling within that lane.

DESCRIPTION OF THE DRAWINGS

For a better understanding of the present invention, and to show more clearly how it may be carried into effect, a preferred embodiment will now be described by way of example only, with reference to the accompanying drawings, in which.

DESCRIPTION OF THE PREFERRED EMBODIMENT

Figure 1:
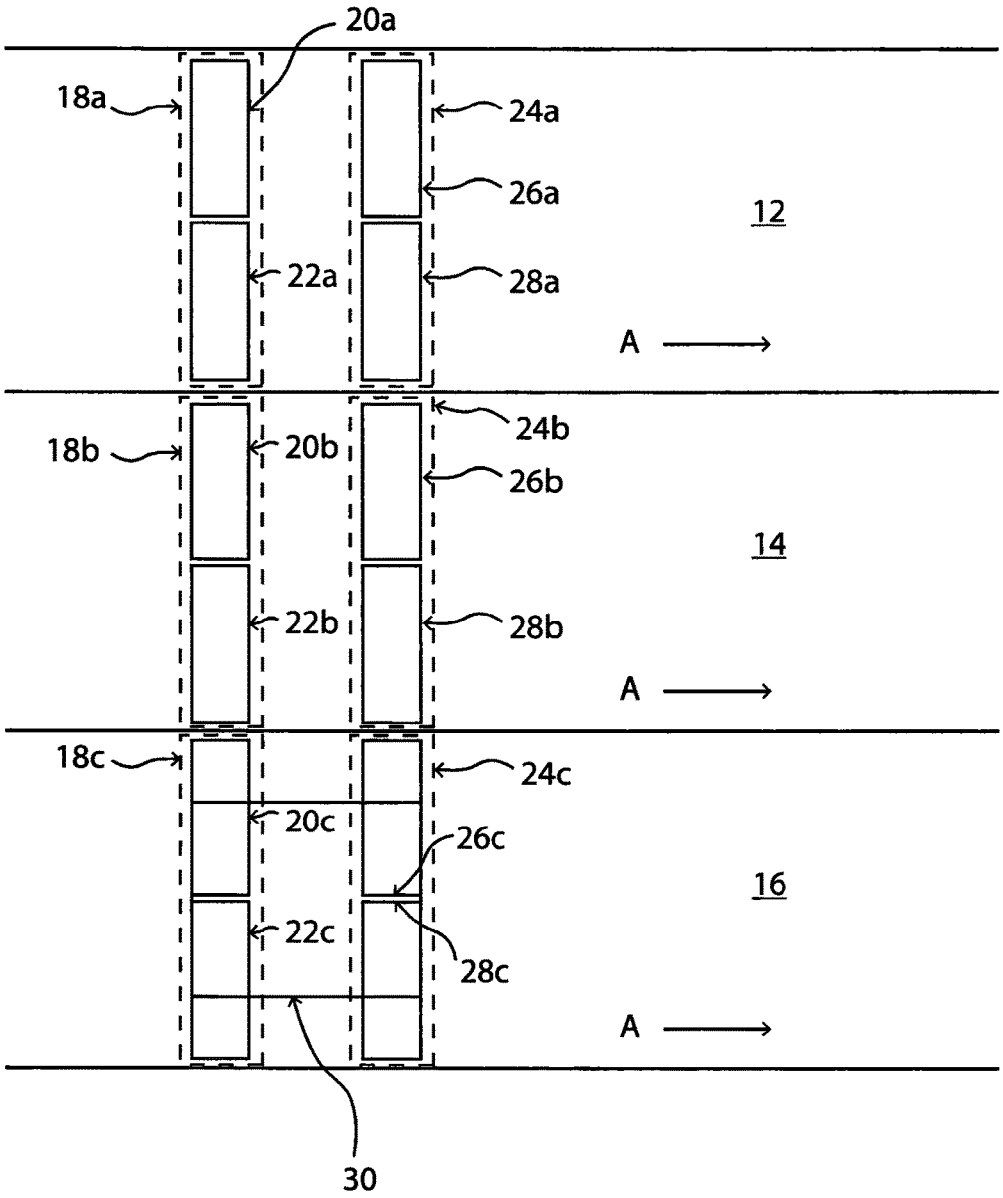
FIG. 1 is a schematic showing the layout of an apparatus for monitoring use of a carriageway according to the invention.

Referring firstly to FIG. 1, a three-lane carriageway is shown. Each lane 12, 14, 16 is for vehicles travelling in the same direction. The direction of travel is indicated by arrows A. In the following description, references to "length" or "along" the lane refer to the direction indicated by arrows A, and references to "width" or "across" the lane refer to a direction substantially perpendicular to arrows A.

A first pair of loops 18*a*, 18*b*, 18*c* is provided respectively across each of the three lanes 12, 14, 16. Each loop pair 18*a*, 18*b*, 18*c* extends substantially across the full width of its respective lane. The loop pair 18*a* includes two loops 20*a*, 22*a*, and likewise the loop pair 18*b* has two loops 20*b*, 22*c*, and the loop pair 18*c* has two loops 20*c*, 22*c*. Each loop 20*abc*, 22*abc* is substantially rectangular, having a length along its respective lane 12, 14, 16 and a width across the lane 12, 14, 16. The width of each loop 20*abc*, 22*abc* is substantially half of the width of its lane, so that the two loops 20*a*, 22*a* together span substantially the full width of the lane 12, loops 20*b* and 22*b* span substantially the full width of the lane 14, and loops 20*c* and 22*c* span substantially the full width of lane 16. The length of each loop 20*abc*, 22*abc* is substantially less than its width. In this embodiment the length of each loop 20*abc*, 22*abc* is substantially around one third of its width, or one sixth of the lane width.

A second pair of loops 24*a*, 24*b*, 24*c* is provided across each of the three lanes 12, 14, 16. The second pair of loops 24*abc* is spaced along the road from the first pair of loops 18*abc*, but is substantially identical to the first pair of loops 18*abc*.

A secondary loop 30 is shown in lane 16. The secondary loop is positioned substantially centrally of lane 18, and is substantially square in shape. The secondary loop 30 has a width significantly less than the width of the lane 18, so that the edges of the secondary loop 30 are spaced from the boundaries of lane 30. The longitudinal boundaries of the secondary loop 30 are coincident with boundaries of the first and second loop pairs 18*c*, 26*c*.

In this embodiment, the secondary loop 30 is shown only in one lane. The purpose of the secondary loop 30 is to increase the detection accuracy in respect of high bed vehicles. In many cases, such vehicles are restricted to using only one or two lanes, and so the secondary loop does not need to be provided in every lane. However, it will be appreciated that a secondary loop can be provided in any lane in circumstances where it would be beneficial.

Each loop is provided with a loop controller (not shown in the Figures). The loop controller energises each loop with an alternating current at a chosen frequency. This allows the inductance of the loop to be measured. The inductance is typically sampled by the loop controller many times each second, for example 100 times each second or more frequently. To avoid unwanted coupling between loops, adjacent loops can be energised with different frequencies.

Alternatively, the loop controllers can be configured to sample the inductance in adjacent loops alternately, so that the inductance in each loop is always measured independently. As long as the sampling rate in an individual loop is high enough for accurate detection bearing in mind the length of the loop and the typical speed of vehicles on the road, this technique is found to be very effective.

The gap between adjacent loop pairs 18*a*, 18*b* in adjacent lanes 12, 14 and between adjacent loop pairs 18*b*, 18*c* in lanes 14, 16 is small, typically less than 30 cm (about 1 foot). The gap between the loop pairs is sufficiently small to ensure that motorcycles cannot pass undetected between loop pairs.

In the embodiment shown, all of the loops 20*abc*, 22*abc*, 24*abc*, 28*abc* are of the same length. This is the most preferred configuration in most circumstances, but in some cases loops may be of differing lengths. It will be appreciated that the calculations described below may be modified to take into account loops of different lengths and/or widths.

The gap between adjacent loops 20, 22 of the same pair 18 is small. In fact, in this embodiment, the loops are in the form of wires embedded in slots cut into the road surface, and the adjacent lateral edges of the loops 20, 22 in the same pair 18 are wires in the same slot.

When a vehicle passes over a loop, the inductance in the loop is generally reduced due to the effect of the conducting materials which make up the vehicle chassis. The magnitude of the change in inductance depends on the height of the bulk of the vehicle above the loop, and the amount of the loop covered by the vehicle. Vehicles with a high chassis tend to cause a lower drop in inductance as they pass over the loop as compared with vehicles which travel low to the ground, and a vehicle which only partially passes over a loop will cause less of a drop in inductance than a vehicle which passes over the full width of the loop. The arrangement of loops as described above therefore permits the vehicle position to be estimated for a wide range of vehicle types. For example, two motorcycles travelling side-by-side in the same lane can be distinguished from a single car, since each motorcycle will likely pass over only a single loop 20 or 22 and the measured drop in inductance will be relatively small due to the small vehicle size. Also, a vehicle straddling two lanes can be reliably detected as such, since (for example) a significant drop in inductance will be measured in loop 22*a* in lane 12 and in loop 20*b* in lane 14, but not in loop 20*a* in lane 12 or in loop 22*b* in lane 14.

The drop in inductance in a loop over the period of time taken for the vehicle to move over the loop gives a "signature" which can be matched to known types of vehicle to estimate whether the passing vehicle is a car, van, bus, etc. In turn, the vehicle width can be estimated and this information may be used to calculate an estimate for the lateral position of the vehicle in the lane.

Figure 2:
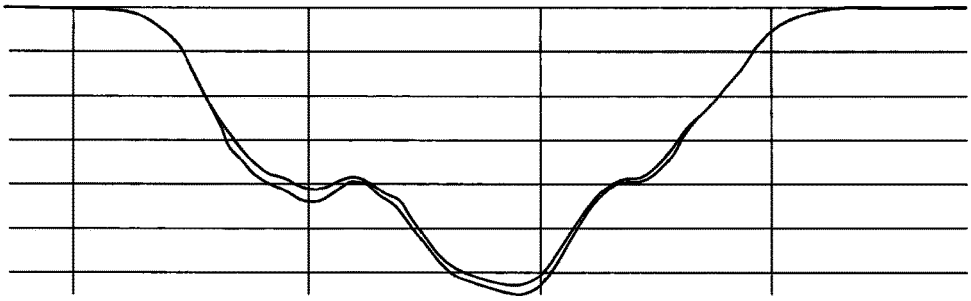
FIG. 2 shows the change in inductance measured in two adjacent loops of the same loop pair, when a vehicle passes substantially centrally over the two loops.
Figure 3:
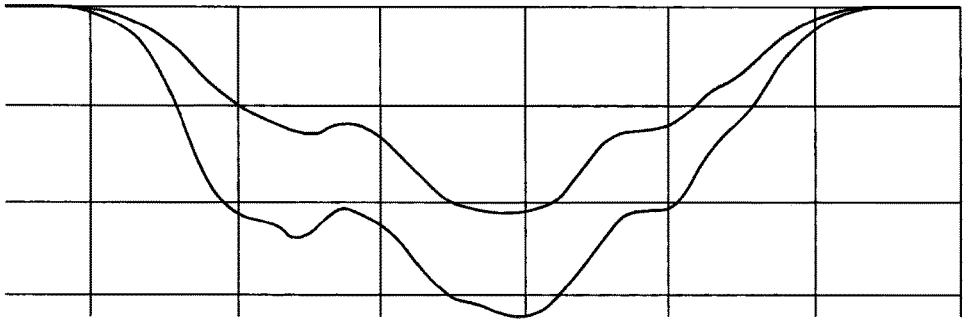
FIG. 3 shows the change in inductance measured in two loops of the same loop pair, when a vehicle passes somewhat off-centre over the two loops.
Figure 4:
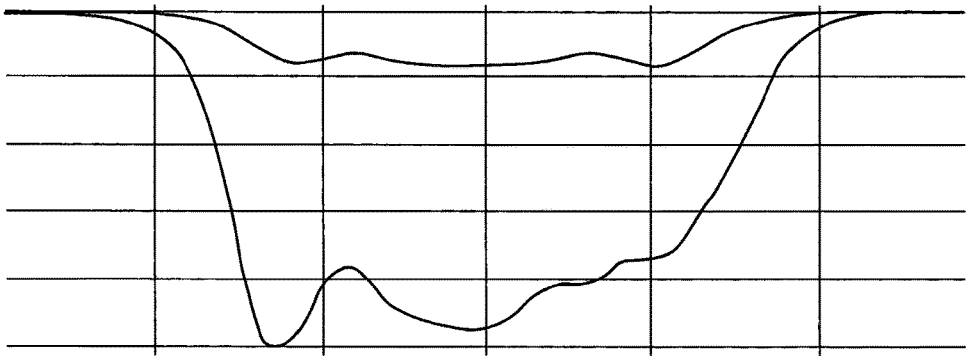
FIG. 4 shows the change in inductance measured in two adjacent loops of the same loop pair, when a vehicle passes over substantially only one of the two loops.

FIGS. 2, 3, and 4 show the inductance of the two loops 20*a*, 22*a* in loop pair 18*a* as measured by the loop controller, while vehicles are passing over the loop pair 18*a* at various positions. In FIG. 2, the vehicle is passing along the lane 12 substantially centrally, and therefore the pattern of the change in inductance in each loop is substantially similar. It is clear from the measurements in this case that a single vehicle is passing. Furthermore, the type of vehicle can be determined by various techniques, such as by matching the shape of the plot to known reference patterns or "signatures".

In FIG. 3, a vehicle is passing over the loop pair 18*a*, offset from the centre of the lane, perhaps just about to change lanes and move into lane 14. From the plot, it is possible first of all to identify that this is a single vehicle offset from the centre of the lane, because the shape of the plot from each loop 20*a*, 22*a* in the pair is substantially identical, but the magnitude is different. Two vehicles (e.g. motorcycles), one passing over each loop, can be identified by a number of inductance plot characteristics, such as calculated length, non-congruency of the plots, combined amplitude, etc., which together serve to clearly separate the case of a single vehicle passing over a loop pair from a pair of vehicles.

The relationship between the proportion of the loop covered by a vehicle and the change in inductance is found to be roughly linear, and therefore the lateral location of the vehicle in the lane 12 can be estimated from the measured inductance changes using the following equation:

$$prop = \frac{(\text{value} - \text{edge})}{value_{adjacent} + \text{value} - 2 \times \text{edge}}$$

prop is the estimated proportion of the vehicle over one of the loops (from which the position of the vehicle in the lane may be derived).

value is the inductance change measured in the loop $value_{adjacent}$ is the inductance change measured in the adjacent loop edge is a reference value estimating the inductance change caused by a vehicle passing next to, but not over, a loop value and $value_{adjacent}$ in most cases can be the peak value of inductance change as the vehicle passes over the loops, although it is generally possible to measure the change over any part of the signature, given that many vehicles are substantially laterally symmetrical. In the case of non-symmetrical vehicles, there are identifiable elements of the vehicles that display good symmetry, and these can be used for calculation.

Note that value, $value_{adjacent}$ and edge are given without units below. Any units for inductance may be used, or alternatively the values may be dimensionless relative quantities.

In FIG. 3, the peak inductance drop over loop 22 in lane 12 is measured as 168. The peak inductance drop over loop 20 in lane 12 is measured as 110. The reference value edge is 10.

The proportion of the vehicle estimated to be positioned over loop 22 is therefore:

$$\frac{168 - 10}{110 + 168 - 2 \times 10} = 0.61$$

In this case it is estimated that around 61% of the vehicle width is positioned over loop 22, perhaps because the vehicle is starting to move into lane 14. From the shape of the plot, the vehicle type can also be estimated, and hence the vehicle width is estimated to a reasonable degree of accuracy. Using this information, the lateral location of the centre of the vehicle with respect to the centre of the lane 12 (the split point between the loops 20 and 22) can be estimated as:

$$\text{location} = (\text{prop} - 0.5) \times \text{width}$$

In this case, the vehicle width is estimated at 1.8 meters, and so the estimated offset from the centre of lane 12 is 0.2 meters. Note that an error in the estimate of vehicle width will cause an error in estimated position which is at most half the amount of that error. It is therefore sufficient in many embodiments to substitute just one constant width value for all vehicles, or perhaps one value for motorcycles, one for cars and one for lorries.

FIG. 4 shows the measured inductance in the loop pair 18*a* when a different vehicle is passing over the loop pair 18*a*. It is clear that the vehicle is substantially offset from the centre of the lane 12, since there is a much greater inductance drop measured in loop 22 than in loop 20. It will also be noted that the shape of the plot in FIG. 4 is different from that in FIG. 2 and FIG. 3, indicating that it is a different type of vehicle. The type of vehicle can be identified by comparing the plot with reference information, and hence the vehicle width estimated in order to determine the vehicle position in the lane as described above.

It is found that in most embodiments, any variation in sensitivity between loops is generally negligible. However, if there is a large variation, for example due to different lead-in lengths, or for example where an incorrect number of turns has been installed or an old loop has been recycled from a legacy installation, a loop-by-loop gain function may be applied to the measured inductance value before processing.

It will be apparent that, although the invention is described in terms of lanes on a carriageway, the apparatus of the invention is applicable in any system where the lateral position of a vehicle needs to be determined as it moves along a road, irrespective of any lane markings. Where a vehicle is wider than a single loop, it may have effect the inductance of three or more loops as it is driven along the road. The calculation as described above can be performed for each loop which is at least partially affected by the vehicle, to determine a good estimate of the lateral position of the vehicle.

The embodiments described above are provided by way of example only, and various changes and modifications will be apparent to persons skilled in the art without departing from the scope of the present invention as defined by the appended claims.

The invention claimed is:

1. An apparatus for monitoring use of a carriageway, the carriageway having two or more adjacent lanes for use by vehicles travelling in a single direction, the apparatus including:

a first pair of inductive loops on or in the surface of one of the two or more lanes, and a second pair of inductive loops on or in the surface of another of the two or more lanes, the loops in each of the first pair and the second pair being positioned substantially side-by-side across the lane and the first pair and the second pair of loops being positioned substantially side-by-side across the carriageway, a width of each loop in the first pair being such that the loops of the first pair together span substantially the full width of the lane, a width of each loop in the second pair being such that the loops of the second pair together span substantially the full width of the another of the two or more lanes, and each loop of the first pair and the second pair having a length in the single direction of vehicle travel which is substantially shorter than the width of the loop across the lane;

a loop controller associated with each loop, each loop controller energizing an associated one of the loops and carrying out measurements of the change in inductance of the associated one of the loops as one of the vehicles passes over that loop; and processing means adapted to receive the measurements from the loop controllers, and adapted to use the measurements to calculate the estimated lateral position of at least one of the vehicles on the carriageway relative to a center of one of the pairs of inductive loops, based on the magnitude of inductance change for one of the loops within the first pair as a proportion of the summed magnitudes of inductance change for both of the loops in the first pair.

2. The apparatus of claim 1, in which an additional pair of loops is provided in each lane, spaced along the carriageway from the first pair and the second pair of loops.

3. The apparatus of claim 2, in which the loops of at least one of the first pair of loops, the second pair of loops, and the additional pair of loops overlap each other.

4. An apparatus for monitoring use of a carriageway, the carriageway having two or more adjacent lanes for use by vehicles travelling in a single direction, the apparatus including:

a first pair of inductive loops on or in the surface of one of the two or more lanes, and a second pair of inductive loops on or in the surface of another of the two or more lanes, the loops in each of the first pair and the second pair being positioned substantially side-by-side across the lane and the first pair and the second pair of loops being positioned substantially side-by-side across the carriageway, a width of each loop in the first pair being such that the loops of the first pair together span substantially the full width of the lane, and each loop of the first pair and the second pair having a length in the single direction of vehicle travel which is substantially shorter than the width of the loop across the lane;

a loop controller associated with each loop, each loop controller energizing an associated one of the loops and carrying out measurements of the change in inductance of the associated one of the loops as one of the vehicles passes over that loop; and processing means adapted to receive the measurements from the loop controllers, and adapted to use the measurements to calculate the estimated lateral position of at least one of the vehicles on the carriageway relative to a center of one of the pairs of inductive loops, based on the magnitude of inductance change for one of the loops within the first pair as a proportion of the summed magnitudes of inductance change for both of the loops in the first pair, in which an additional pair of loops is provided in each lane, spaced along the carriageway from the first pair and the second pair of loops, in which the loops of at least one of the first pair of loops, the second pair of loops, and the additional pair of loops overlap each other, and in which the loops of the first pair or the second pair overlap each other, and in which the loops of the additional pair do not overlap.

5. The apparatus of claim 1, in which the loop controllers energize the loops in the first pair with different frequencies.

6. The apparatus of claim 1, in which the loop controllers are configured not to energize the loops of the first pair at the same time.

7. The apparatus of claim 1, in which a secondary loop is provided in at least one lane, the secondary loop having a length along the lane which is substantially greater than the length of the loops in the first pair and the second pair.

8. The apparatus of claim 7, in which the secondary loop has a length substantially similar to its width.

9. The apparatus of claim 7, in which the secondary loop is positioned substantially centrally of the lane.

10. The apparatus of claim 7, in which the secondary loop is coincident with the first pair of loops on the same lane.

11. An apparatus for monitoring use of a carriageway, the carriageway having two or more adjacent lanes for use by vehicles travelling in a single direction, the apparatus including:

a first pair of inductive loops on or in the surface of one of the two or more lanes, and a second pair of inductive loops on or in the surface of another of the two or more lanes, the loops in each of the first pair and the second pair being positioned substantially side-by-side across the lane and the first pair and the second pair of loops being positioned substantially side-by-side across the carriageway, a width of each loop in the first pair being such that the loops of the first pair together span substantially the full width of the lane, and each loop of the first pair and the second pair having a length in the single direction of vehicle travel which is substantially shorter than the width of the loop across the lane;

a loop controller associated with each loop, each loop controller energizing an associated one of the loops and carrying out measurements of the change in inductance of the associated one of the loops as one of the vehicles passes over that loop; and processing means adapted to receive the measurements from the loop controllers, and adapted to use the measurements to calculate the estimated lateral position of at least one of the vehicles on the carriageway relative to a center of one of the pairs of inductive loops, based on the magnitude of inductance change for one of the loops within the first pair as a proportion of the summed magnitudes of inductance change for both of the loops in the first pair, in which a secondary loop is provided in at least one lane, the secondary loop having a length along the lane which is substantially greater than the length of the loops in the first pair and the second pair, and in which an additional pair of loops is provided in each lane, spaced along the carriageway from the first pair and the second pair of loops, and in which the secondary loop is coincident with one of the first pair and the second pair of loops and also with the additional pair of loops on the same lane.

* * * * *